United States Patent [19]

Milne

[11] Patent Number: 4,729,749

[45] Date of Patent: Mar. 8, 1988

[54] BALLOON STEM CONNECTOR

[75] Inventor: James A. Milne, Crystal Lake, Ill.

[73] Assignee: CTI Industries Corporation, Barrington, Ill.

[21] Appl. No.: 939,970

[22] Filed: Dec. 10, 1986

[51] Int. Cl.[4] ..... A63H 3/06; A01N 3/00

[52] U.S. Cl. ..... 446/222; 428/24

[58] Field of Search ..... 446/222; 24/5, 590, 24/30.5 L; 428/23, 24, 25, 26

[56] References Cited

U.S. PATENT DOCUMENTS

| | | | |
|---|---|---|---|
| 1,543,954 | 6/1925 | Shira | 446/222 |
| 1,748,636 | 2/1930 | Crockett | 428/26 |
| 2,664,667 | 1/1954 | Burroughs | 446/222 |
| 3,041,766 | 7/1962 | De Camp | 428/24 |
| 3,096,766 | 7/1963 | Patton | 24/30.5 L |
| 3,309,742 | 3/1967 | Chin | 24/30.5 L |
| 3,780,419 | 12/1973 | Allison et al. | 446/222 |

FOREIGN PATENT DOCUMENTS

| | | | |
|---|---|---|---|
| 271959 | 1/1964 | Australia | 24/30.5 L |
| 290424 | 2/1916 | Fed. Rep. of Germany | 428/24 |

*Primary Examiner*—Robert A. Hafer
*Assistant Examiner*—Charles H. Harris
*Attorney, Agent, or Firm*—Wood, Dalton, Phillips, Mason & Rowe

[57] ABSTRACT

Balloon stem connector for securing a balloon by its neck to the end of a stem-like object includes a wire formed slot at the end of the stem for receiving the balloon neck. A capture element having a tubular body portion is fitted in sleeve-like fashion to slide along the stem from a position where the slot is fully exposed to a captive position where it envelops a substantial portion of the loop. The capture element also has balloon positioning body portions outwardly flaring from the tubular body.

5 Claims, 4 Drawing Figures

BALLOON STEM CONNECTOR

The present invention relates to an improved arrangement for affixing a balloon at the end of a stem-like object.

In recent years relatively small balloons made of plastic film have been affixed at the ends of plain rods, at the end of artificial rose stems, and similar stem-like members. The plastic film balloons typically are formed of a plurality (two is most common) panels of plastic laminate film (which may or may not be metallized) with the panels being heat sealed along their edge portions to form the balloon envelope. A filler port is generally formed at the base of the balloon by appropriately shaped portions of the panels and, after the balloon is inflated, the filler port is sealed. The filler port has the appearance of a small neck of the balloon. The balloon neck is available as a means for connecting the balloon to other objects such as rods and artificial stems.

Various connection techniques and means have been used to secure balloons by their necks at the ends of various rods, straws and other stem-like objects (hereinafter referred to as "stems"). One such prior art stem connector comprises a rod having an integral loop at one end that is bendable to define a plane transverse to the axis of the rod. An integral clip-like member is formed near the same end. The balloon neck is threaded through the loop and, after the loop has bent, is wrapped around the rod. The wrapped neck material is then pushed under the clip and is restrained thereby from unwrapping.

Another prior art stem connector comprises a cup or funnel like member having a number of slots formed therein. At the base of the funnel, a tube-like rod holder (i.e., female recepticle) is formed. The balloon neck is inserted into one of the slots of the cup wall, wrapped around the base, and, finally, inserted into one or more of the other slots to prevent unwrapping.

The foregoing prior art methods and means suffer drawbacks including cumbersome assembly operations and rather unsightly appearance at the point of connection. It is, accordingly, the objective of the present invention to provide improved means for connecting a balloon by its neck at the end of a stem, such means being such as to not only facilitate the assembly (i.e., connection of balloon to stem) but also to produce a visually pleasing appearance at the point of connection.

SUMMARY OF THE INVENTION

In accordance with the present invention there is provided a balloon stem connector for securing a balloon by its neck to the end of a stem which comprises means affixed to the stem for forming an elongated balloon neck receiving slot adjacent the balloon end, and balloon capture means including a generally tubularly shaped body fittable in sleeve-like fashion on the stem to slide therealong in frictional engagement therewith from a position wherein the slot is fully exposed to a capture position wherein a portion of the body envelops a substantial portion of the slot, whereby the balloon neck may be inserted into the slot when it is exposed and captively held therein when the body is slid to the capture position, the capture means further including positioning means for orienting the balloon in a predetermined orientation when the body is at the capture position.

In a preferred form the slot forming means comprises a length of wire that has a U-shaped bend about midway therealong to form a pair of spaced apart legs.

The positioning means in a preferred form comprises a cup or funnel-shaped portion of the body.

Other features and advantages of the invention will be apparent from the following description and claims and are illustrated in the accompanying drawings which show structure embodying preferred features of the present invention and the principles thereof, and what is now considered to be the best mode in which to apply these principles.

BRIEF DESCRIPTION OF THE DRAWINGS

In the accompanying drawings forming a part of the specification, and in which like numerals are employed to designate like parts throughout the same.

DETAILED DESCRIPTION

Figure 1:
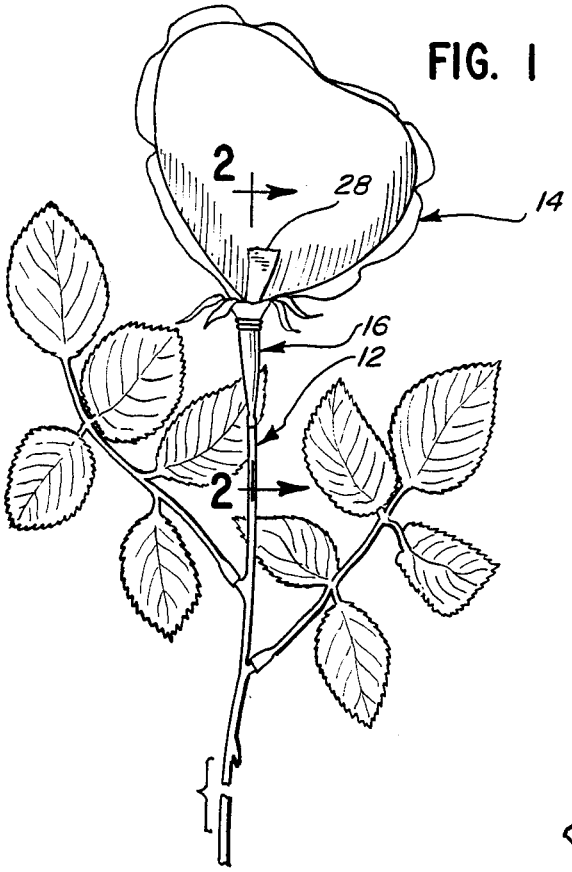
FIG. 1 is an elevational view of a balloon stem connector embodying the principles of the present invention, the stem and stem connector being in the ornamental form of an artificial rose stem and the calyx of the rose, respectively.
Figure 3:
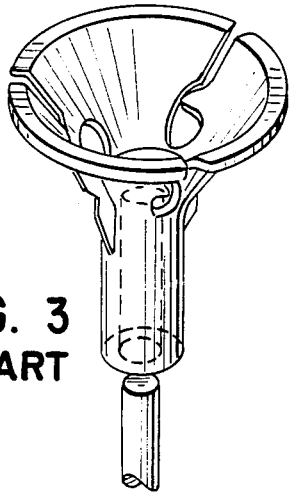
FIG. 3 PRIOR ART
FIGS. 3 and 4 illustrate the prior art stem connectors noted hereinabove.

For purposes of illustrative disclosure the balloon stem connector of the present invention is shown in FIG. 1 embodied in an artificial rose assembly 10 that includes an artificial rose stem 12, a balloon 14 serving as a rose, and an artificial rose calyx 16. Details of the balloon stem connector are illustrated in FIG. 2.

Figure 2:
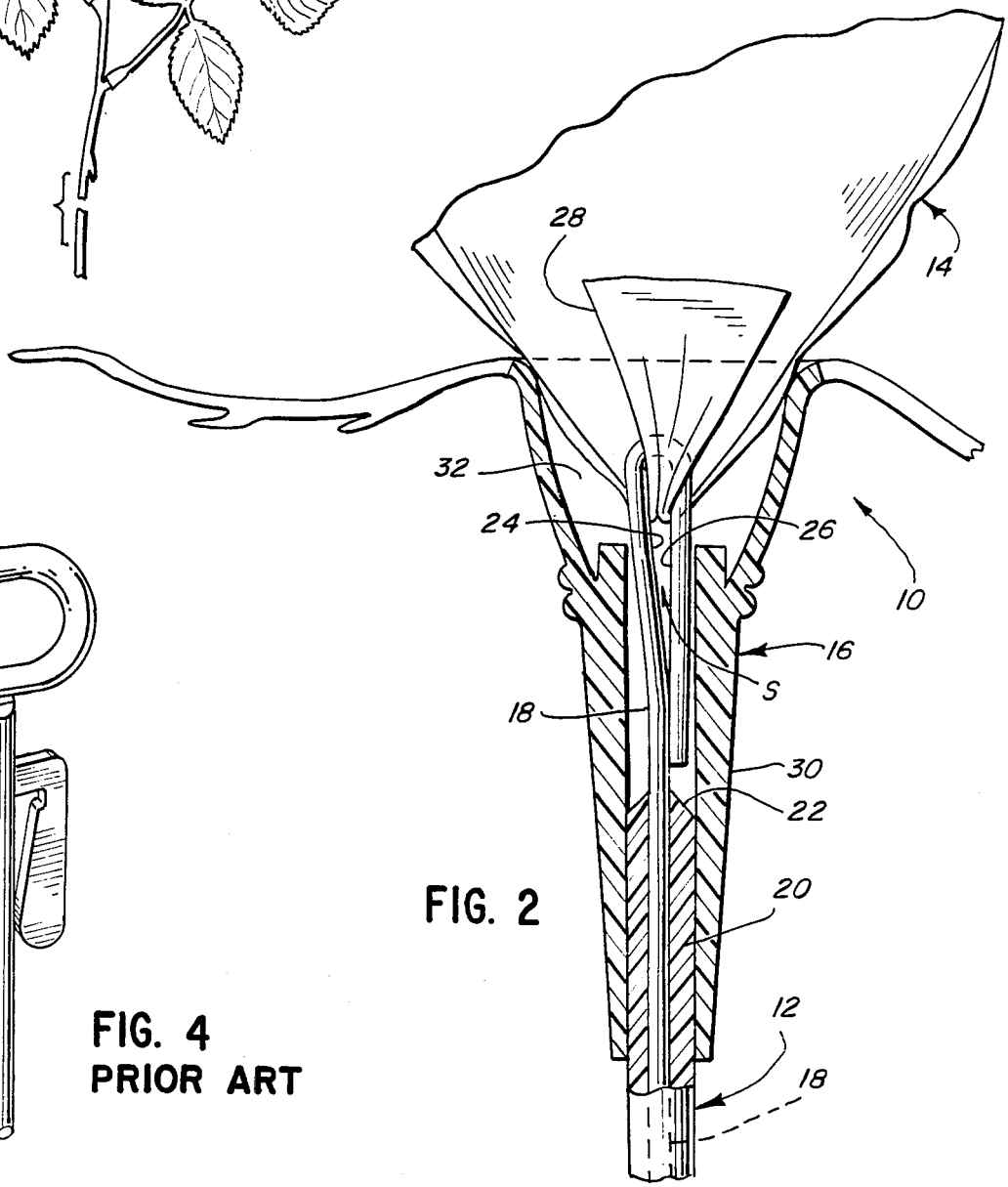
FIG. 2 is an enlarged sectional view taken, as indicated, along the line 2—2 of FIG. 1.
Figure 4:
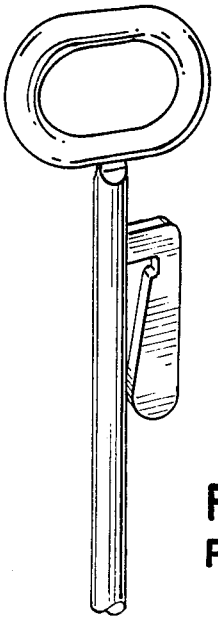
FIG. 4 PRIOR ART

With reference to FIG. 2, the stem 12 comprises a conventional artificial flower stem that includes a wire 18 having an outer coating 20 of L.D. polyethylene or similar plastic material except at the end 22 of the stem a length of the wire 18 is not so coated. Approximately midway along the length of the uncoated length of wire 18, the wire 18 has a generally U-shaped bend to form a pair of adjacent legs 24, 26 with the space between legs 24, 26 forming a slot S for receiving the balloon neck material 28.

The calyx 16 of FIG. 1, as shown in FIG. 2, actually comprises balloon capture means that includes a generally tubularly shaped body portion 30 that fits in sleeve-like fashion on the stem 12 to slide therealong in frictional engagement therewith from a position wherein the slot S formed by the legs 24, 26 of wire 18 is fully exposed to a capture position (where the body 30 is shown in FIG. 2) wherein a portion of the body 30 envelops a substantial portion of slot S.

It will thus be apparent that when the body 30 is slid downwardly (in FIG. 2) from the capture position to expose the slot S, the balloon neck material 28 may easily be threaded through the slot S. Thereafter, when the body 30 is slid to the capture position shown in FIG. 2, the balloon neck material 28 is tightly squeezed within the reduced unexposed portion of slot S and, hence, captively retained.

The capture means further includes balloon positioning means for properly orienting the balloon when body 30 is at the capture position. In the illustrated embodiment wherein the capture means is intended to simulate a rose calyx 16, the positioning means comprises a generally cup or funnel shaped wall 32 formed integrally of body 30 at the balloon confronting end thereof. It should be appreciated, however, that the positioning means may take a variety of forms. For example, it will be noted that the balloon 14 in the illustrated embodiment need make and, in fact, makes point contact with wall 32 at only several locations. A plurality of outwardly flared fingers could, hence, serve in place of the cup shaped wall 32 for purposes of balloon positioning if it were not necessary that the capture means have the appearance of a rose calyx.

In the illustrated embodiment the outer diameter of the stem 12 and the inner diameter of the body 30 is approximately 0.150 inch. The exposed length of wire 18 extends about 1-9/16 inches with the U-shaped bend being about 13/16 inch from the end 22 of the stem. The clearance between the legs 24, 26 at the base or web of the U-shaped bend is about 1/16 inch. It should be noted that, preferably, wire 18 is bent slightly beyond 180° to prevent binding of the body 30 as it is slid to the capture position. The longitudinal dimension of the body 30 is about 1⅛ inch.

While preferred constructional features of the invention are embodied in the structure illustrated herein, it is to be understood that changes and variations may be made by those skilled in the art without departing from the spirit and scope of the appended claims.

What is claimed is:

1. The combination comprising a balloon having a neck and a balloon stem connector, said connector comprising a supporting stem for the balloon, balloon capture means securing a portion of said balloon at the end of said supporting stem, and means affixed to said supporting stem at said end forming an elongated balloon neck receiving slot adjacent said end, said balloon capture means including a generally tubularly shaped body fittable in sleeve-like fashion on said supporting stem to slide therealong in frictional engagement therewith from a position wherein said slot is fully exposed to a capture position wherein a portion of said body envelops a substantial portion of said slot, whereby the balloon neck is inserted into said slot when the same is exposed and captively held therein when said body is slid to said capture position, said capture means further including balloon positioning means for orienting said balloon in a predetermined orientation when said body is at said capture position.

2. The combination of claim 1, said slot forming means comprising a length of wire having a generally U-shaped bend about midway therealong, said slot being defined by the space between the legs of said length of wire formed by said bend.

3. The combination of claim 1 wherein the balloon positioning means comprises outwardly flared integral portions of said body.

4. The combination of claim 3 wherein said outwardly flared integral portions comprise regions of a generally funnel shaped end portion of said body.

5. The combination of claim 1 wherein said slot has a slot opening immediately adjacent said end to facilitate insertion of the balloon neck into the slot.

* * * * *